US009057578B2

(12) United States Patent
Liao

(10) Patent No.: US 9,057,578 B2
(45) Date of Patent: Jun. 16, 2015

(54) SIMULATION BULLET INCLUDABLE BB BULLET MAGAZINE

(71) Applicant: GUAY GUAY TRADING CO., LTD., New Taipei (TW)

(72) Inventor: Yin-Hsi Liao, New Taipei (TW)

(73) Assignee: Guay Guay Trading Co., Ltd., New Taipei (TW)

( * ) Notice: Subject to any disclaimer, the term of this patent is extended or adjusted under 35 U.S.C. 154(b) by 9 days.

(21) Appl. No.: 14/022,240

(22) Filed: Sep. 10, 2013

(65) Prior Publication Data

US 2015/0068508 A1 Mar. 12, 2015

(51) Int. Cl.

| | |
|---|---|
| ***F41B 11/00*** | (2013.01) |
| ***F41A 9/00*** | (2006.01) |
| ***F41A 9/37*** | (2006.01) |
| ***F41B 11/50*** | (2013.01) |
| ***F41B 11/55*** | (2013.01) |
| ***F41A 9/62*** | (2006.01) |

(52) U.S. Cl.

CPC ..... *F41B 11/50* (2013.01); *F41B 11/55* (2013.01); *F41A 9/62* (2013.01)

(58) Field of Classification Search

CPC ..... F41B 11/55; F41A 9/62
USPC ..... 124/51.1, 52, 53, 45; 446/473; 42/7, 42/49.01, 54; 206/3
See application file for complete search history.

(56) References Cited

U.S. PATENT DOCUMENTS

| | | | | | |
|---|---|---|---|---|---|
| 1,734,852 | A * | 11/1929 | Frampton et al. | 42/87 |
| 3,043,198 | A * | 7/1962 | Burns et al. | 89/33.1 |
| 4,109,401 | A * | 8/1978 | Musgrave | 42/50 |
| 4,694,815 | A * | 9/1987 | Hung | 124/27 |
| 4,850,127 | A * | 7/1989 | Davis et al. | 42/71.01 |
| 5,206,444 | A * | 4/1993 | Oliver | 42/1.02 |
| 5,319,872 | A * | 6/1994 | Bammate | 42/88 |
| 5,519,953 | A * | 5/1996 | Villani | 42/1.02 |
| 5,592,769 | A * | 1/1997 | Villani | 42/1.02 |
| 5,613,482 | A * | 3/1997 | Thai et al. | 124/16 |
| 5,711,286 | A * | 1/1998 | Petrosyan et al. | 124/73 |
| 5,755,055 | A * | 5/1998 | Thompson et al. | 42/71.01 |
| 6,073,620 | A * | 6/2000 | Kunimoto | 124/74 |
| 6,094,850 | A * | 8/2000 | Villani | 42/1.02 |
| 6,694,658 | B1 * | 2/2004 | Marsac | 42/54 |
| 8,011,355 | B2 * | 9/2011 | Kawashima | 124/57 |
| 8,327,568 | B1 * | 12/2012 | Lavergne et al. | 42/71.01 |
| 2006/0042613 | A1 * | 3/2006 | Hu | 124/48 |
| 2006/0053671 | A1 * | 3/2006 | Weinberger | 42/1.01 |
| 2010/0043766 | A1 * | 2/2010 | Iwasawa | 124/40 |
| 2011/0030667 | A1 * | 2/2011 | Lin | 124/52 |

* cited by examiner

*Primary Examiner* — Melba Bumgarner
*Assistant Examiner* — Alexander Niconovich
(74) *Attorney, Agent, or Firm* — Leong C. Lei

(57) ABSTRACT

A simulation bullet includable BB bullet magazine includes an enclosure, an elastic element arranged in the enclosure, an internal receptacle slidably received in the enclosure, and at least one simulation bullet movably receivable in the enclosure. The internal receptacle has an end coupled to the elastic element. The simulation bullet is arranged to contact the end of the internal receptacle that is distant from the elastic element. With such a structure, when the simulation bullet is loaded into the enclosure, the internal receptacle is pressed downwards. To shoot BB bullets, the simulation bullet is pushed out of the enclosure, whereby the elastic element moves the internal receptacle upward to a ready-to-shoot position. As such, a user, when operating and using the device, can fully experience of the fun of operation and thus, an advantage of being interesting and easy to operate can be achieved.

5 Claims, 5 Drawing Sheets

SIMULATION BULLET INCLUDABLE BB BULLET MAGAZINE

TECHNICAL FIELD OF THE INVENTION

The present invention generally relates to a structure for use in a BB gun to simulate loading bullets in a magazine of a real gun, and more particularly to a simulation bullet includable BB bullet magazine that provides fun and is easy to operate.

DESCRIPTION OF THE PRIOR ART

A toy gun is a common toy, which uses a mechanical structure to shoot BB bullets in order to simulate the shooting of a real gun to achieve the purpose of playing.

With the progress of the modem society, the structures of the toy guns get more elaborate and more complicated in order to provide a player with the experience of operating a real gun. Thus, the manufacturers have been devoted themselves to the improvement of every detail.

However, no matter how the toy gun has been made to mimic a real gun, the object shot therefrom is different from a real bullet. This will affect the structure of the bullet magazine. For a bullet magazine of a real gun, since the bullet is composed of a projectile and a case and the structure of a magazine is made to correspond thereto. On the other hand, the magazine of a toy gun is structured to receive BB bullets in a bullet chute. For the purposes of mimicking, it is desired to provide a bullet magazine of a toy gun that provides a player with the perception of loading bullets similar to real bullet. This is a challenge to the manufacturers of the industry and the present inventor.

SUMMARY OF THE INVENTION

In view of the above problems, through intense research and study of related information, as well as repeated trials and corrections, a novel design of a simulation bullet includable BB bullet magazine is achieved according to the present invention.

An object of the present invention is that an enclosure is structured to receive an internal receptacle therein and an elastic element is provided to allow the internal receptacle to slide up and down in the enclosure, whereby the operation of loading a simulation bullet provides a sense of operating a real gun in the use and operation thereof Loading the simulation bullet causes the internal receptacle to be pressed down and pushing the simulation bullet out of the enclosure allows the elastic element to bias the internal receptacle to an operation position. With such a technique, the problem that the conventional toy gun magazine does not provide a sense of operating a real gun can be overcome and an advantage of being interesting and easy to operate can be achieved.

To achieve the above object, the present invention provides a simulation bullet includable BB bullet magazine, which comprises an enclosure in which an elastic element is arranged, an internal receptacle slidably received in the enclosure, and at least one simulation bullet movably receivable in the enclosure. The internal receptacle has an end coupled to the elastic element and the simulation bullet is arranged to contact the end of the internal receptacle that is distant from the elastic element.

With such a structure, BB bullets of the toy gun are first loaded into the internal receptacle and then the simulation bullet is loaded into the enclosure. Under this condition, the internal receptacle is depressed by the simulation bullet to move towards the lower end of the enclosure. With such a structure, simulation of the sense of operation and interesting of loading a real gun is realized. When the simulation bullet is pushed out of the enclosure, the internal receptacle is caused by the action of the elastic element to slide upwards so that the internal receptacle may get to a ready-to-shoot position and get ready to shoot the BB bullets. As such, an advantage of being interesting and easy to operate can be achieved.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
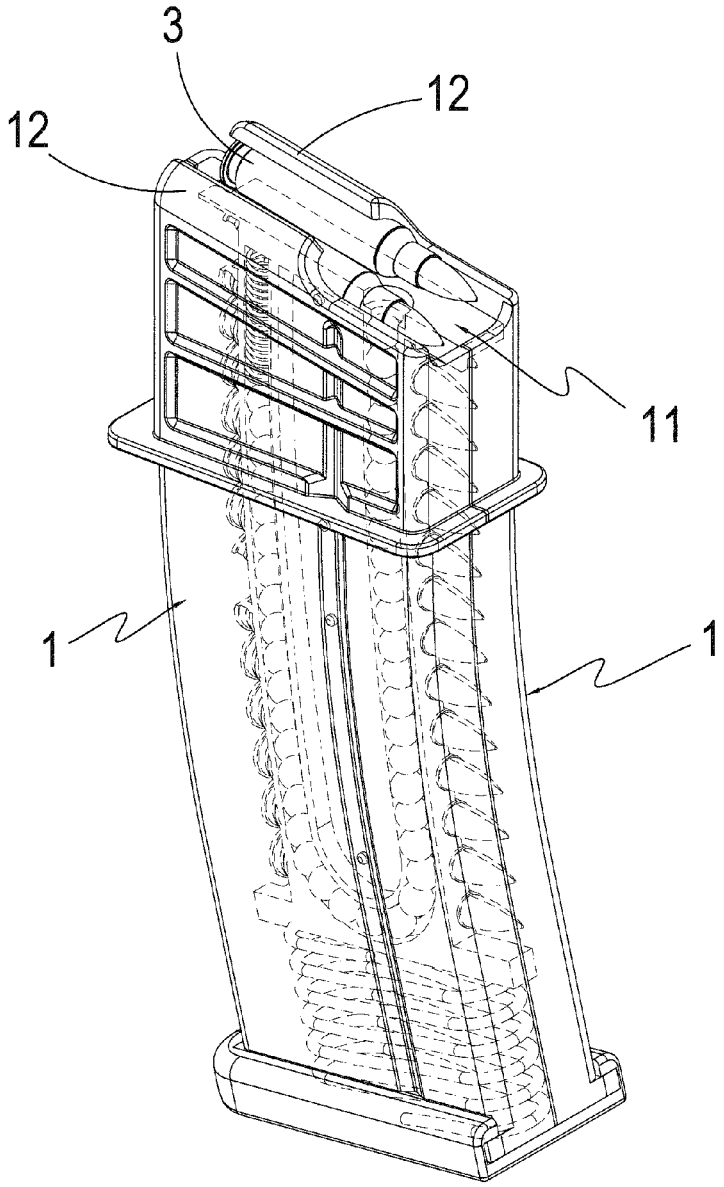
FIG. 1 is a perspective view showing a preferred embodiment of the present invention.
Figure 2:
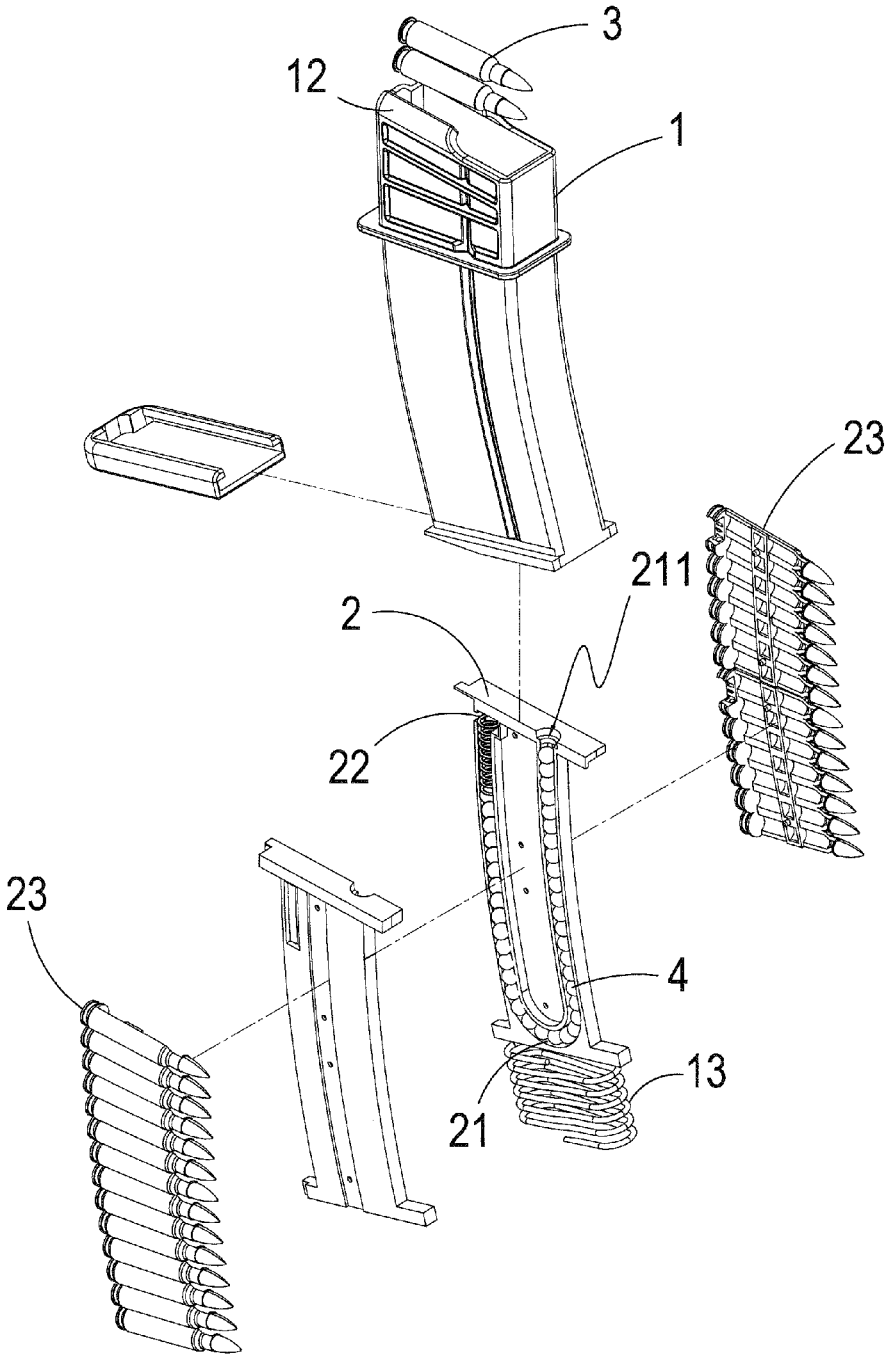
FIG. 2 is an exploded view showing the preferred embodiment of the present invention.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to FIGS. 1, 2, 3, 4, and 5, which are respectively a perspective view and an exploded view of a preferred embodiment of the present invention and schematic views showing an operation of the preferred embodiment of the present invention, these drawings clearly show that the present invention comprises:

an enclosure 1, the enclosure 1 having an end forming an opening 11 and an end that is distant from the opening 11 and has an inside wall on which an elastic element 13 is mounted, a constraint section 12 being provided at the opening 11, the enclosure 1 having two opposite sides each of which comprises a transparent material;

an internal receptacle 2 that is received in the enclosure 1 and is up-and-down slidable, the internal receptacle 2 comprising a bullet supply channel 21 formed therein to receive and hold BB bullets 4, the bullet supply channel 21 comprising a compression spring 22 arranged therein to bias the BB bullets 4 toward a bullet supply channel opening 211, the internal receptacle 2 further comprising two opposite decoration plates 23 attached to two opposite sides thereof, an end of the internal receptacle 2 that is distant from the bullet supply channel opening 211 being coupled to the elastic element 13; and at least one simulation bullet 3 movably receivable in the enclosure 1, the simulation bullet 3 being in contact with the end of the internal receptacle 2 that is associated with the bullet supply channel opening 211.

Figure 3:
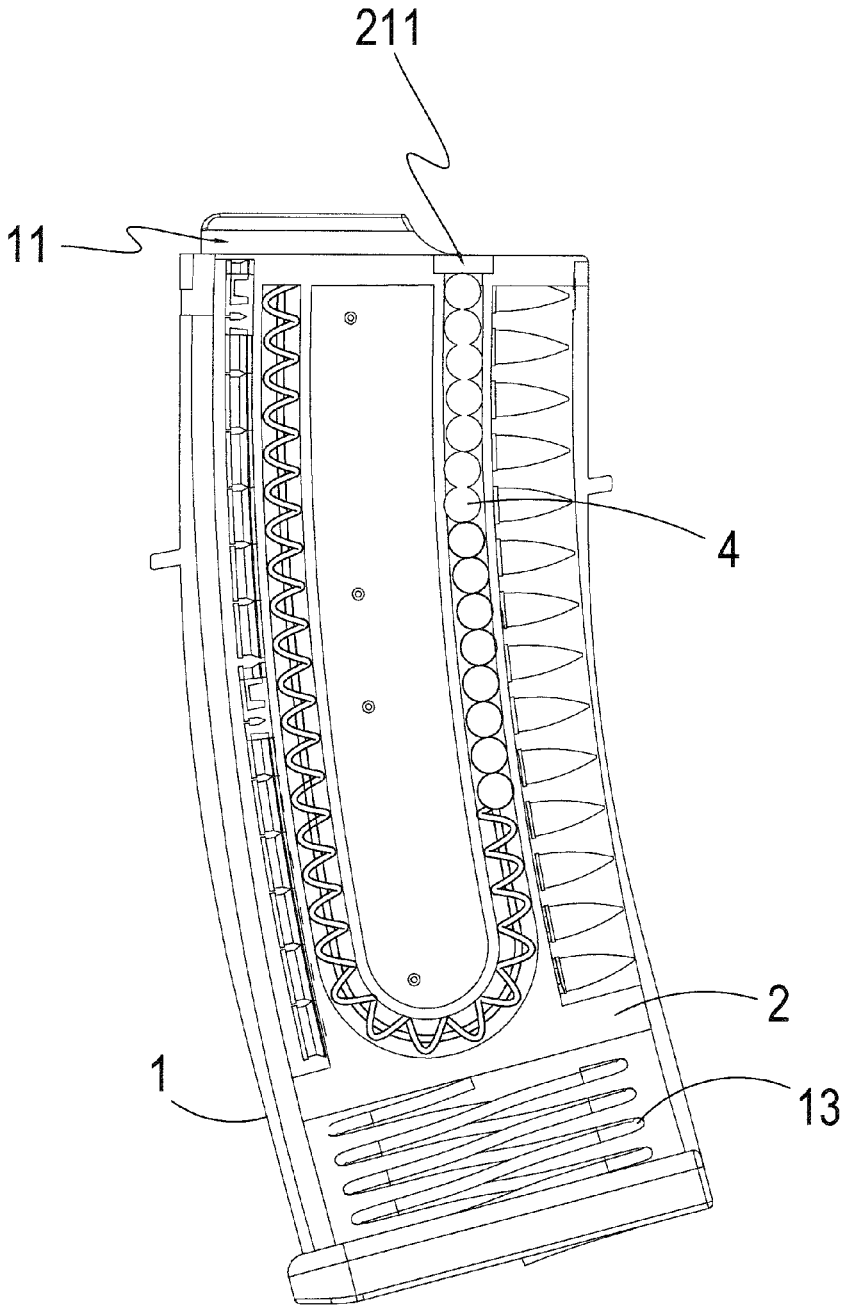
FIG. 3 is a schematic view showing an operation of the preferred embodiment of the present invention.
Figure 4:
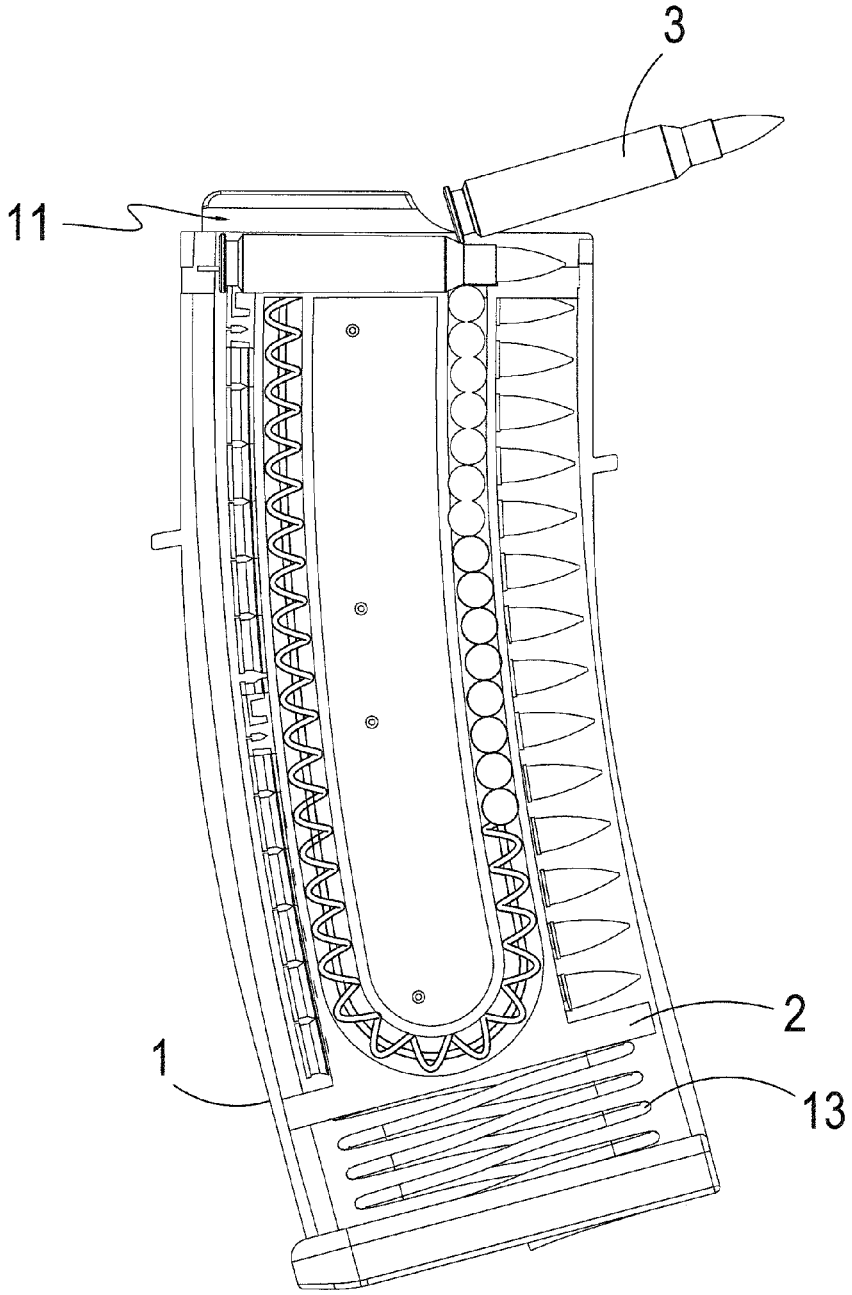
FIG. 4 is a schematic view showing the operation of the preferred embodiment of the present invention.
Figure 5:
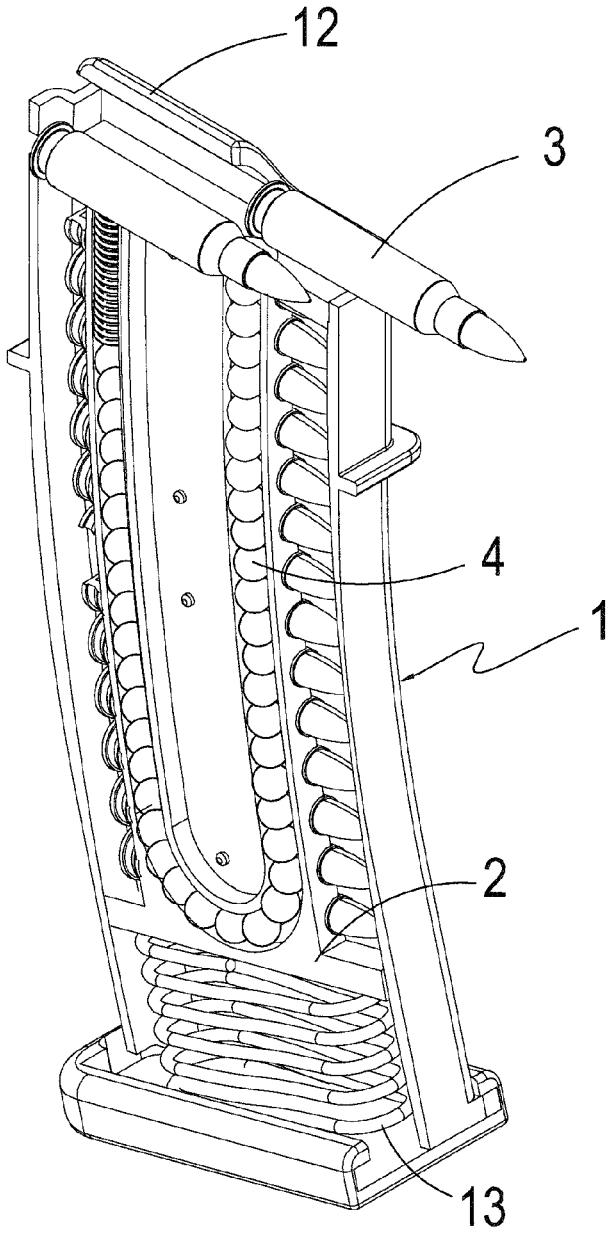
FIG. 5 is a schematic view showing the operation of the preferred embodiment of the present invention.

With the above-described structure, together with the following description of an operation of the present invention, the details of the operation of the simulation bullet includable BB bullet magazine according to the present invention can be better understood. Referring to FIG. 3, which illustrates the enclosure 1 in a condition where no simulation bullet 3 is included. It can be clearly seen from the drawing, the internal receptacle 2 is driven by the elastic element 13 so that the internal receptacle 2 is moved to a ready-to-shoot position. The BB bullets 4 received in the bullet supply channel 21 are also driven by the compression spring 22 to the bullet supply channel opening 211 to be ready for subsequent bullet loading. Referring to FIG. 4, which shows the enclosure 1 in a condition of loading the simulation bullet 3, to load a simulation bullet 3 into the enclosure 1, the internal receptacle 2 is first moved in a direction toward the lower end of the enclosure 1 to provide a space for receiving and containing the simulation bullet 3. At this situation, the elastic element 13 is about to be compressed to allow the simulation bullet 3 to be inserted through the opening 11 into the enclosure 1. When the loading of the simulation bullet 3 is completed, the internal receptacle 2 is acted upon by the elastic element 13 so that the internal receptacle 2 is pushed toward the opening 11 and the simulation bullet 3 is forced by the internal receptacle 2 to move upwards and, together with position constraint imposed by the constraint section 12, the simulation bullet 3 is securely retained on the internal receptacle 2. This, together with the arrangement of the decoration plate 23, provides an overall view exactly similar to a real bullet magazine. Besides providing the visual perception of a real device, the present invention also provides an operation of loading bullet that allows a user to experience of loading a real gun. Referring to FIG. 5, which shows a condition where a simulation bullet 3 is pushed out of the enclosure 1, due to the arrangement and design of the constraint section 12 are exactly identical to a bullet retaining lip of a real gun, the simulation bullet 3 is only allowed to be pushed out in a frontward direction. When one of multiple simulation bullets 3 received in the enclosure is pushed out, the internal space of the enclosure 1 is relatively enlarged and the internal receptacle 2 is acted upon by the elastic element 13 to simultaneously move in a direction toward the opening 11. When the simulation bullets 3 have been all pushed out, the internal receptacle 2 reaches the ready-to-shoot position, as what described with reference to FIG. 3 so that no further description will be given here. As such, with such an arrangement and operation, an innovated, brand new structure of a toy gun for use with simulation bullets 3, where a user may experience the interesting and feeling of operation of loading a real gun with real bullets. Further, the transparent materials included in the enclosure 1 and the arrangement of the decoration plates 23 provide the perception of an overall view of a real gun magazine. Further, with the arrangement of the internal receptacle 2 in combination with the elastic element 13, loading and unloading of the simulation bullet 3 are easy and convenient so that an advantage of interesting and easy operation according to the present invention can be achieved.

Thus, the technical features that the simulation bullet includable BB bullet magazine according to the present invention adopt to improve the drawbacks of the conventional devices are as follows:

An enclosure 1 is structured to receive and hold therein an internal receptacle 2 and simulation bullets 3. A constraint section 12 and an elastic element 13 are provided so that loading and unloading of the simulation bullets 3 are such that the sense of operation and interesting are exactly the same as loading bullets in a real gun. Further, the operation mode that the internal receptacle 2 is slidable up and down within the enclosure 1 makes it not greatly different from the existing ones so that a user does not need to adapt to the new device so that the advantage of being interesting and easy to operate can be achieved.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A simulation bullet includable BB bullet magazine, comprising:

an enclosure, in which an elastic element is arranged;

an internal receptacle, which is received in and slidable up and down within the enclosure and is adapted to receive and hold therein BB bullets, the internal receptacle having an end coupled to the elastic element; and at least one simulation bullet, which is different, in shape and size, from the BB bullets and is removably receivable in the enclosure, the simulation bullet being in contact with an end of the internal receptacle that is distant from the elastic element;

wherein the simulation bullet is shaped and sized to simulate a genuine bullet so as to provide an operation of simulating loading a real gun.

2. The simulation bullet includable BB bullet magazine according to claim 1, wherein the enclosure has an end forming an opening and an end that is distant from the opening and has an inside wall on which the elastic element is mounted, the internal receptacle being received in the enclosure, a constraint section being provided at the opening for position constraining of the simulation bullet.

3. The simulation bullet includable BB bullet magazine according to claim 1, wherein the internal receptacle comprises a bullet supply channel formed therein to receive the BB bullets, the bullet supply channel comprising a compression spring arranged therein to bias the BB bullets towards a bullet supply channel opening.

4. The simulation bullet includable BB bullet magazine according to claim 1, wherein the internal receptacle comprises two opposite decoration plates, each of which is structured to imitate an appearance of genuine bullets.

5. The simulation bullet includable BB bullet magazine according to claim 4, wherein the enclosure has two opposite sides each of which comprises a transparent material through which the decoration plates are visible.

* * * * *